United States Patent [19]

Morimoto et al.

[11] Patent Number: 4,877,508

[45] Date of Patent: Oct. 31, 1989

[54] HIGHLY DURABLE CATHODE OF LOW HYDROGEN OVERVOLTAGE AND METHOD FOR MANUFACTURING THE SAME

[75] Inventors: Takeshi Morimoto; Eiji Endoh, both of Yokohama, Japan

[73] Assignee: Asahi Glass Company, Ltd., Tokyo, Japan

[21] Appl. No.: 253,616

[22] Filed: Oct. 5, 1988

Related U.S. Application Data

[63] Continuation of Ser. No. 834,332, Feb. 4, 1986, Pat. No. 4,780,452.

[51] Int. Cl.[4] ..... C25B 11/04; C25B 11/06

[52] U.S. Cl. ..... 204/290 R; 204/292; 204/293

[58] Field of Search ..... 204/290 R, 290 F, 292, 204/293

[56] References Cited

U.S. PATENT DOCUMENTS

| | | | |
|---|---|---|---|
| 4,080,278 | 3/1978 | Ravier et al. | 204/292 |
| 4,170,536 | 10/1979 | Kawasaki et al. | 204/290 R |
| 4,374,712 | 2/1983 | Gray | 204/293 |

FOREIGN PATENT DOCUMENTS

| | | | |
|---|---|---|---|
| 1143325 | 3/1983 | Canada . | |
| 2015032 A | 9/1979 | United Kingdom | 204/290 F |

*Primary Examiner*—John F. Niebling
*Assistant Examiner*—Kathryn Gorgos
*Attorney, Agent, or Firm*—Oblon, Spivak, McClelland, Maier & Neustadt

[57] ABSTRACT

A highly durable cathode of a low hydrogen overvoltage with particles of an electrode active metal being stuck on the core material of the electrode, wherein a part or all of the electrode active metal particles is a hydrogen absorbing metal which is capable of electrochemically absorbing and desorbing hydrogen.

12 Claims, 1 Drawing Sheet

Figure 1:
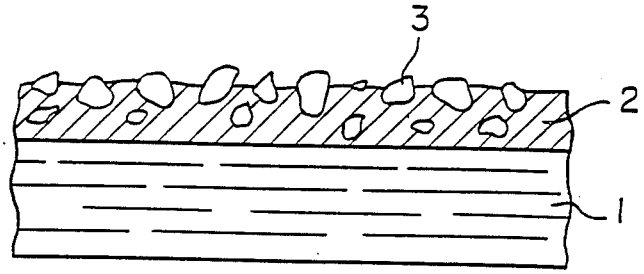

HIGHLY DURABLE CATHODE OF LOW HYDROGEN OVERVOLTAGE AND METHOD FOR MANUFACTURING THE SAME

This is a continuation, of application Ser. No. 06/834,332, filed Feb. 4, 1986, now U.S. Pat. No. 4,789,452.

TECHNICAL FIELD

The present invention relates to a highly durable cathode of a low hydrogen overvoltage, and, more particularly, it is concerned with a cathode of low hydrogen overvoltage, which has a very low deterioration in its properties even under an oxidizing atmosphere, and with a method for its manufacture.

TECHNICAL BACKGROUND

There have been proposed various cathodes of low hydrogen overvoltage, in particular, a cathode for electrolysis of an alkali metal halide aqueous solution. Of these electrodes, the one which has already been proposed by the present applicant and is disclosed in the unexamined Japanese patent publication No. 112785/1979 possesses a remarkable effect relative to its low hydrogen overvoltage and durability in comparison with that of electrodes which has thus far been known. However, as the result of further studies having been made, the present inventors have found that, depending on circumstances, even the electrode as disclosed in the above-mentioned unexamined Japanese patent publication does not always exhibit sufficient durability, and after strenuous efforts having been made for the solution of this problem, they have accomplished the present invention.

Production, in an electrolytic cell of alkali metal halide aqueous solution, of halogen gas from its anode compartment, and of aqueous solution of caustic alkali and hydrogen gas from its cathode compartment is the industrialized method of manufacturing chlorine and caustic alkali, which is already well known. As the cathode for this electrolytic cell, a cathode of a low hydrogen overvoltage as mentioned above is used preferably. However, the above-mentioned electrolytic cell is liable to bring about stoppage in operation in the course of its running for various reasons, and in this case, the hydrogen overvoltage is recognized to increase when its operation is resumed. As the result of pursuing this phenomenon in depth, the present inventors discovered that, in the case of stoppage in operation of the electrolytic cell by a method, in which the anode and the cathode are short-circuited through a bus bar, the cathode is oxidized by reverse current to be generated at the time of the short-circuiting, and that, in the case of the cathode being made up of nickel and cobalt as its active components, these substances become modified to hydroxides to thereby decrease the electrode activity, which does not return to the original active state even after its operation will have been resumed (i.e., increase in the hydrogen overvoltage).

Moreover, it has been found that, even in the method of stopping operation in the electrolytic cell by ceasing conduction of electric current without short-circuiting the anode and the cathode and, if the cathode is immersed over a long period of time in aqueous solution of NaOH at a high temperature and with a high concentration, the active component of the cathode, when it is made of nickel or cobalt, rushes into a corrosion potential to be modified into its hydroxide (this reaction is also a sort of electro-chemical oxidation reaction), whereby the electrode activity lowers.

DISCLOSURE OF THE INVENTION

Under the circumstances, studies had been made strenuously with a view to preventing such phenomenon from taking place. As the result, it was discovered that, when a hydrogen absorbing metal which absorbs and desorbs hydrogen electro-chemically and has a low hydrogen overvoltage is used for a part or a whole of the electrode active component, a large amount of hydrogen absorbed in the hydrogen absorbing metal is electro-chemically oxidized at the time of stopping operation of the electrolytic cell as described in the foregoing, whereby the electrode active component can be effectively prevented from its oxidation; in other words, the electrode activity can be maintained over a long period of time. On the basis of this finding, the present invention has been completed. The present invention, as its gist, is to propose a highly durable cathode of a low hydrogen overvoltage having electrode active metal particles provided on the core material of the electrode, in which a part or all of the electrode active metal particles is a hydrogen absorbing metal capable of electro-chemically absorbing and desorbing hydrogen; and a method for manufacturing, to be described later, the above-mentioned highly durable cathode of a low hydrogen overvoltage.

Throughout this specification, "the hydrogen absorbing metal capable of electro-chemically absorbing and desorbing hydrogen" is meant by those which carry out the following electrode reaction in an alkaline aqueous solution. That is to say, in the reducing reaction, these metals which absorb therein the hydrogen atoms produced by reduction of water; while, in the oxidation reaction, those which carry out a reaction wherein the absorbed hydrogen is reacted with hydroxy ions on the surface of such metals to produce water. The reaction equation for the above will be shown in the following.

$$xH_2O + Xe + M \underset{\text{(desorption)}}{\overset{\text{(absorption)}}{\rightleftharpoons}} MHx + xOH^- \quad (1)$$

In the above equation, M designates a hydrogen absorbing metal, and MHx refers to a hydrogenated substance thereof. When the sodium chloride electrolysis is carried out by, for example, the ion-membrane method using a cathode, in which this hydrogen absorbing metal is made a part or all of the electrode active particles, hydrogen is absorbed in the hydrogen absorbing metal at the initial stage of the electric current conduction due to the rightward reaction in the above reaction equation (1). As soon as the hydrogen absorption reaches its saturation, hydrogen is generated on the surface of the hydrogen absorbing metal due to the following reaction (2), whereby the electrode reaction proceeds on the original cathode.

$$H_2O + e \rightarrow \tfrac{1}{2}H_2 + OH^- \quad (2)$$

On the other hand, at the time of stoppage of operation of the electrolytic cell due to the short-circuiting, etc. thereof, a large amount of hydrogen which has been absorbed in the hydrogen absorbing metal is desorbed electro-chemically due to the leftward reaction in the above reaction equation (1), i.e., by electrochemical oxidation of hydrogen to bear the oxidation current, the oxidation of the electrode active particles per se can be effectively prevented.

Thus, as described in the foregoing, the hydrogen absorbing metals usable in the present invention are capable of electrochemically absorbing and desorbing hydrogen. Concrete examples of such metals are: lanthanum/nickel system alloys represented by $LaNi_{5-x}X_xY_y$, etc. (where: x is $0 \leqq x \leqq 5$, $0 \leqq y \leqq 5$; and X, Y denote other metals); Misch-metal/nickel system alloys represented by $M_mNi_{5-x}X_xY_y$ (where: $M_m$ is Misch-metal; x, y, X and Y are all same as above); titanium/-nickel system alloys represented by $TiNi_x$ (where: x is $0 < x \leqq 2$); and others. It should, however, be noted that the hydrogen absorbing alloys for use in the present invention is not limited to these examples alone.

Since the hydrogen overvoltage of these metals is generally low, the fine particles of these metals, when used as the electrode active substance, are able to contribute to effective reduction in the hydrogen overvoltage. Moreover, it goes without saying that, for further reduction in the overvoltage, particles of Raney nickel, Raney cobalt, and so forth having a lower hydrogen overvoltage may be made coexistent with these hydrogen absorbing metals.

In this case, the content of the hydrogen absorbing metal should preferably be 30% by weight or more with respect to the entire electrode active metal, or more preferably 50% or more, for attaining the intended purpose.

Furthermore, as it is already known that the hydrogen absorbing metal brings about brittle fracture due to its absorption and desorption of hydrogen into and out of it to become pulverized, there may be taken various preventive means against exfoliation, etc. of such metal due to its pulverization such that use is made of the metal which has beforehand been mechanically comminuted or electro-chemically pulverized by repeating absorption and desorption of hydrogen gas into and out of the metal in a gas phase, or use is made of particles of other metals than the above-mentioned Raney nickel and Raney cobalt, such as, for example, nickel powder, as the matrix material for prevention of such exfoliation with addition of polymer powder, and the like as a binder.

It is further preferable to effect micro-encapsulation, in which the metal particles are covered with a thin metal layer by means of the chemical plating. In this case, since the thin metal layer has, in general, micropores therein to permit communication between its exterior and its interior, the metal to constitute such a thin layer should preferably possess hydrogen permeability, when considering its performance as the electrode, although it is not always required to have such hydrogen permeability.

Such metals having the hydrogen permeability should preferably be selected from among various metals such as nickel, cobalt, iron, and so forth. Besides these, palladium may also be used preferably, save for its being expensive.

Thickness of the above-mentioned metal thin film depends on the properties of the thin film (such as density, hydrogen permeating velocity, hydrogen dissolving quantity), the properties of the hydrogen absorbing metal particles (such as hydrogen permeating velocity, density), and size of the metal particle. In more detail, the thickness of the coating layer should not become thicker, as the diffusion of hydrogen in the coating layer is reaching its rate determining stage in the whole process of the hydrogen absorption and desorption, and moreover, it should possess a thickness having sufficient strength to be able to withstand a volumetric change in the hydrogen absorbing metal due to its hydrogen absorption and desorption, and to suppress pulverization of the metal. However, increasing the thickness to be more than is required would cause a reduction in the weight ratio of the hydrogen absorbing metal in the micro-encapsulated hydrogen absorbing metal, hence, the reduction in quantity of the hydrogen absorbing metal per unit volume of the micro-encapsulated body. In general, satisfactory results can be obtained when the thickness of the layer is selected so that the weight of the metal constituting the thin layer may become 30% or less of the weight of the hydrogen absorbing metal particles, or more preferably it may range from 5 to 15% or so.

In general, since the hydrogen absorbing metal particles are used in their average particle diameter of from 0.1 micron to 100 microns or so, the thickness of the thin metal layer should preferably be in a range of from 0.01 to 20 microns, or more preferably from 0.03 to 10 microns or so, although it may differ from metal to metal. When the thickness is smaller than the above-mentioned lower limit, the effect cf preventing the hydrogen absorbing metal from its pulverization becomes poor. On the contrary, when the thickness is larger than the above-mentioned upper limit, the hydrogen permeating velocity becomes small to render it difficult to attain the purpose of the present invention to its full extent. In addition, the average particle diameter of the above-mentioned hydrogen absorbing metal particle may sufficiently be in a range of from 0.1 micron to 100 microns, though it may be dependent on porosity of the electrode surface and dispersibility of the particles at the time of manufacturing the electrode; the latter being described in detail at a later paragraph. Of the above-mentioned range of the average particle diameter, a preferred range thereof is from 0.9 micron to 50 microns, or a more preferred range is from 1 micron to 30 microns, from the standpoint of the porosity in the electrode surface, and others.

A preferred embodiment of the cathode according to the present invention is one such that the electrode active metal particles are adhered onto the core material constituting the electrode through a plating metal. In this case, the plating metal is provided in a layer form on the core material for the electrode, and the electrode active metal particles are exposed in part on the surface of the plating metal layer.

Furthermore, the metal particles to be used for the present invention should preferably have a surface porosity for the sake of attaining a lower hydrogen overvoltage in the electrode as defined below.

The term "surface porosity" is not meant to be that the whole surface of the particle should be porous, but it is sufficient that only the portion of the particle, which is exposed from the above-mentioned plating metal layer, may have such porosity.

While the porosity should preferably be as high as possible, when it is excessively high, the mechanical strength of the layer provided on the core material for the electrode becomes lowered, on account of which the porosity should preferably range from 20 to 90%. In this porosity range, a preferred range is from 35 to 85%, and a more preferred range is from 50 to 80%.

Incidentally, the term "porosity" is a value measured by the pressurized mercury permeation method or the water substitution method, both of which are known. It is desirable that the layer for rigidly fastening the above-mentioned electrode active metal particles onto the metal substrate may be made of a metal material same as that of a part of the component constituting the metal particle.

Thus, a large number of the above-mentioned particles are adhered on the surface of the cathode according to the present invention, the surface of which has a multitude of micro-pores, when viewed macroscopically.

As such, the cathode of the present invention has a large number of particles containing in themselves the hydrogen absorbing metal having a low hydrogen overvoltage scattered on the electrode surface, and as already mentioned in the foregoing, the electrode surface has the micro-pores, on account of which the electrode active surface is enlarged for that porosity, and the hydrogen overvoltage can be effectively reduced by the synergistic effect of the metal particles and the surface porosity.

In addition, since the particles to be used in the present invention, in its preferred embodiment as described above, are rigidly adhered onto the electrode surface by the layer composed of the above-mentioned metal material, the electrode becomes less deteriorative, whereby the low hydrogen overvoltage thereof can be sustained over a remarkably long period of time.

The core material for the electrode according to the present invention may be adopted from any of those appropriate electrically conductive metals selected, for example, from Ti, Zr, Fe, Ni, V, Mo, Cu, Ag, Mn, platinum group metals, graphite, and Cr, or any alloy of these metals. Of these materials, Fe, Fe alloys (Fe-Ni alloy, Fe-Cr alloy, Fe-Ni-Cr alloy, etc), Ni, Ni alloys (Ni-Cu alloy, Ni-Cr alloy, etc.), Cu, and Cu alloy may be preferably adopted. The particularly preferred core material for the electrode are Fe, Cu, Ni, Fe-Ni alloy, and Fe-Ni-Cr alloy.

The structure of the electrode core may take any appropriate shape and size in conformity to the structure of the electrode to be used. Its shape may be, for example, in plate, in porous plate, in net (such as, for example, expanded metal, etc.), in reed or bamboo blind, and others. The electrode core in such various shapes may further be worked into a flat plate form, a curved plate form, o a cylindrical form.

The thickness of the layer according to the present invention, in its preferred embodiment as mentioned in the foregoing, may sufficiently be in a range of from 20 microns to 2 mm, or more preferably from 25 microns to 1 mm, although it is governed by the particle size of the particles to be used. The reason for limiting the thickness of the layer to the above-mentioned range is that, in the present invention, a part of the above-mentioned particles are adhered onto the layer of a metal provided on the electrode core in a state of its being embedded therein. For the ready understanding of such a state, a cross-sectional view of the electrode surface according to the present invention is illustrated in FIG. 1 of the accompanying drawing. As shown in the drawing, the layer 2 made of a metal is provided on the electrode core 1, and a part of the electrode active metal particles 3 is embedded in the layer in a manner to be exposed from the surface of the layer. By the way, a ratio of the particles in layer 2 may preferably be in a range of from 5 to 80% by weight, and, more preferably in a range of from 10 to 60% by weight. Besides such embodiment, an intermediate layer of a metal selected from Ni, Co, Ag, and Cu is interposed between the electrode core and the layer containing therein the metal particles of the present invention, thereby making it possible to further improve the durability of the electrode according to the present invention. While such an intermediate layer may be made of the same kind of metals as that of the above-mentioned layer, or of a different kind of metal from that, it would still be preferable that the metal material constituting these intermediate layer and the top layer be of the same kind from the standpoint of maintaining good adhesivity between these intermediate layer and the top layer. The thickness of the intermediate layer may sufficiently be in a range of from 5 to 100 microns from the point of its mechanical strength, etc. A more preferred range thereof is from 20 to 80 microns, and a particularly preferred range thereof is from 30 to 50 microns.

Figure 2:
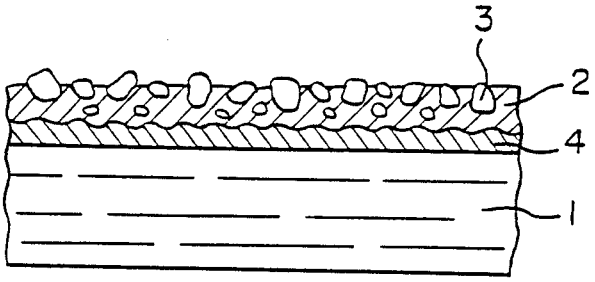

For the ready understanding of the electrode provided with such intermediate layer, a cross-sectional view of the electrode is shown in FIG. 2. In the drawing, a reference numeral 1 designates the electrode core body, a numeral 4 refers to the intermediate layer, a numeral 2 denotes the layer containing therein the metal particles, and a reference numeral 3 indicates the electrode active particles.

As the practical method of adhering the electrode active metal particles, there may be employed various expedients such as, for example, the composite plating method, the melt coating method, the baking method, the pressure forming and sintering method, and so forth. Of these various methods, the composite plating method is particularly preferable, because it is able to adhere the electrode active metal particles on the layer in good condition.

The composite plating method is such one that the plating is carried out on the electrode core, as the cathode, in a bath prepared by dispersing metal particles containing therein nickel, for example, as a part of the component constituting the metal particles, in an aqueous solution containing metal ion to form the metal layer, thereby electrolytically co-depositing the above-mentioned metal and the metal particles on the electrode core. In more detail, it is presumed that the metal particles are rendered bipolar in the bath due to influence of the electrical field to thereby increase the local current density for the plating when they come closer to the vicinity of the surface of the cathode, and to be electrolytically co-deposited on the electrode core by the metal plating due to the ordinary reduction of the metal ion when they come into contact with the cathode.

For example, when the nickel layer is to be adopted as the metal layer, there may be emoted various nickel plating baths such as the all nickel chloride bath, the high nickel chloride bath, the nickel chloride/nickel acetate bath, the Watts bath, the nickel sulfamate bath, and so forth.

The amount of such metal particles in the bath should preferably be in a range of from 1 gr/lit. to 200 gr/lit. for the sake of maintaining in good condition the adhesion onto the electrode surface of the metal particles. Further, the temperature condition during the dispersion plating may range from 20° to 80° C., and the current density for the work may preferably be in a range of from 1 A/dm$^2$ to 20 A/dm$^2$.

It may, of course, be permitted that an appropriate quantity of an additive for reducing distortion, and an additive for promoting the electrolytic co-deposition, and others be added to the plating bath.

Also, with a view to further improving the adhesive strength of the metal particles, there may be carried out in an appropriate manner after completion of the composite plating the electrolytic plating or the non-electrolytic plating to such an extent that the metal particles may not be coated entirely, or the baking under heat in an inactive or reductive atmosphere.

Besides the above, as mentioned in the foregoing, when the intermediate layer is provided between the electrode core and the metal layer containing therein the metal particles, the electrode core is first subjected to the nickel plating, the cobalt plating or the copper plating, after which the metal layer containing therein the metal particles is formed on the intermediate layer by the above-mentioned dispersion plating method, melt spraying method, and so on.

As the plating bath in such a case, there may be adopted various plating baths as mentioned in the foregoing. For the copper plating, too, the well known plating bath may be adopted.

In this manner, there can be obtained the electrode of the construction, in which the electrode active metal particles containing therein the hydrogen absorbing metal are adhered onto the electrode core body through the metal layer.

In the following, explanations will be given as to another method of manufacturing the cathode according to the present invention.

The cathode of the present invention can also be manufactured by the melt coating method or the baking method. In more detail, the hydrogen absorbing metal powder or a mixture of the hydrogen absorbing metal powder and other metal powder of low hydrogen overvoltage (for example, a mixture powder obtained by the melt and crushing method, etc.) is adjusted to a predetermined particle size, and then such mixture powder is melt-sprayed on the electrode core by means of plasma, oxygen/acetylene flame, etc. to thereby obtain the coating layer on the electrode core, in which the metal particles are partially exposed, or dispersion liquid or slurry of the metal particles is coated on the electrode core, and then the coated layer is subjected to baking by calcination to thereby obtain the desired coating layer.

Furthermore, the cathode according to the present invention may be obtained by prefabricating the electrode in sheet form containing therein the hydrogen absorbing metal, and then attaching the electrode sheet onto the electrode core body. In this case, the electrode sheet should preferably be prefabricated by a method, wherein particles of the hydrogen absorbing metal, or a mixture of the hydrogen absorbing metal particles and other metal particles (for example, a Raney alloy, etc. exhibiting a low hydrogen overvoltage characteristic) are blended with an organic polymer particles to be shaped into a desired shape, after which the shaped body is calcined to be the electrode sheet. Needless to say, the electrode active particles are exposed, in this case, from the surface of the electrode sheet. The thus obtained electrode sheet is press-contacted onto the electrode core body, and then firmly fixed on the electrode core by heating.

The electrode according to the present invention may, of course, be adopted as the cathode, in particular, as the cathode for electrolysis of alkali metal chloride aqueous solution by means of the ion-exchange membrane method. Beside this, it may be employed as the electrode for electrolysis of alkali metal chloride using a porous diaphragm (such as, for example, an asbestos diaphragm).

When it is used as the cathode for electrolysis of alkali metal chloride, it takes place sometimes that the iron content eluting into the catholyte from the material constituting the electrolytic cell is electrolytically deposited onto the cathode to lower the electrode activity. In order to prevent the electrode activity from decreasing, it may be an effective way to adhere onto the cathode of the present invention a non-electronic conductive substance as disclosed in the unexamined Japanese patent publication No. 143482/1982.

BRIEF EXPLANATIONS OF THE DRAWING

FIG. 1 is a cross-sectional view of the surface part of one embodiment of the electrode according to the present invention; and FIG. 2 is a cross-sectional view of the surface part of another embodiment of the electrode according to the present invention.

THE BEST MODE TO PRACTISE THE INVENTION

EXAMPLE 1

$LaNi_5$ available in the general market was comminuted to a size of 500 meshes or below. The pulverized powder was put in a nickel chloride bath (composed of 300 gr/lit. of $NiCl_2.6H_2O$, and 38 gr/lit. of $H_3BO_3$) at a rate of 5 gr/lit. While sufficiently agitating the bath, the composite plating was carried out with the expanded metal of nickel as the cathode, and the nickel plate as the anode. For the plating, the temperature was maintained at 40° C., the pH value of the bath at 2.5, and the current density at 4 A/dm$^2$. As the result of this, there was obtained the composite plated layer in blackish gray color. The co-deposited quantity of $LaNi_5$ was 10 gr/dm$^2$. The thickness of the plated layer was approximately 250 microns, and its porosity was approximately 60%.

Subsequently, this electrode was used as the cathode for sodium chloride electrolysis with $RuO_2$-$TiO_2$ as the anode and a fluorine-containing cationic ion-exchange membrane (a product of Asahi Glass Co., Ltd.—a copolymer of $CF_2=CF_2$ and $CF_2=CFO(CF_2)_3COOCH_3$ having an ion-exchange capacity of 1.45 meq/gr of resin) as the ion-exchange membrane to test its resistance against short-circuiting. The following short-circuiting test was conducted on the third day after commencement of the electrolysis with use of 3N of NaCl solution as the anolyte and 35% NaOH solution as the catholyte, and at a current density of 20 A/dm$^2$ at a temperature of 90° C.

First of all, the electrolytic operation was stopped by short-circuiting the anode and the cathode during the electrolysis by means of copper wire, which was left as it was for above five hours. During this non-operative period, the current flowing from the cathode to the anode was observed. Incidentally, the temperature of the catholyte was maintained at 90° C. Thereafter, the copper wire was removed to resume the electrolysis. After repeating these operations for five times, the electrode was taken out to measure its hydrogen overvoltage in 35% solution of NaOH at 90° C. and at a current density of 20 A/dm$^2$, as the result of which it was found that the hydrogen overvoltage was 0.12 V which was not substantially different from the value before commencement of the test.

EXAMPLE 2

$LaNi_5$ available in general market was comminuted to a size of 25 microns or below. The pulverized powder was put in a nickel chloride bath (composed of 300 gr/lit. of $NiCl_2.6H_2O$ and 38 gr/lit. of $H_3BO_3$) at a rate of 5 gr/lit. Further, Raney nickel alloy powder available in general market (a product of Kawaken Fine Chemicals, Co., Ltd.—composed of 50% by weight of nickel and 50% by weight of aluminum and having a particle size passing through a 200-mesh sieve) was added to the above-mentioned plating liquid at a rate of 5 gr/lit. while sufficiently agitating the bath, the composite plating was carried out with the expanded metal of iron as the cathode and the nickel plate as the anode. For the plating, the temperature of the bath was maintained at 40° C., the pH value at 2.5, and the current density at 3 A/dm$^2$. As the result of this, there was obtained the composite plated layer with $LaNi_5$ and the Raney nickel alloy being coexistent therein, the co-deposited quantity of $LaNi_5$ being 6 gr/dm$^2$ and the co-deposited quantity of the Raney nickel alloy being 2 gr/dm$^2$. The thickness of this plated layer was approximately 300 microns and its porosity was approximately 65%. This plated layer specimen was immersed for two hours in 25% solutions of NaOH at 90° C., to develop aluminum in the Raney nickel alloy, after which the short-circuiting test same as in Example 1 above was conducted. After completion of the test, the hydrogen overvoltage was measured, the result having been 0.08 V which was not substantially different from the value before commencement of the test.

EXAMPLE 3

$LaNi_5$ powder (a particle size of 30 microns or below) and stabilized Raney nickel powder (product of Kawaken Fine Chemicals Co., Ltd. marketed under a tradename of "DRY RANEY NICKEL"), both being available in general market, were put into a high nickel chloride bath (composed of 200 gr/lit. of $NiSO_4.6H_2O$, 175 gr/lit. of $NiCl_2.6H_2O$, and 40 gr/lit. of $H_3BO_3$) at a rate of 10 gr/lit. for each of them. While sufficiently agitating the bath, the composite plating was carried out with the punched metal of nickel as the cathode and the nickel plate as the anode. For the plating, the temperature of the bath was maintained at 50° C., the pH value at 3.0, and the current density at 4 A/dm$^2$. As the result of this, there was obtained the composite plated layer containing therein $LaNi_5$ and stabilized Raney nickel, wherein the co-deposited quantity of $LaNi_5$ was 5 gr/dm$^2$, and the co-deposited quantity of stabilized Raney nickel was 2 gr/dm$^2$. The thickness of this plated layer was approximately 250 microns, and its porosity was approximately 60%. Using this plated layer, the same short-circuiting test as in Example 1 above was conducted. After completion of the test, the hydrogen overvoltage was measured with the result that it showed 0.07 V which was not substantially different from the value prior to the test.

EXAMPLE 4

$LaNi_5$ powder (a particle size of 15 microns or below) available in general market was put into a high nickel chloride bath (composed of 200 gr/lit. of $NiSO_4.6H_2O$, 175 gr/lit. of $NiCl_2.6H_2O$, and 40 gr/lit. of $H_3BO_3$) at a rate of 10 gr/lit. While sufficiently agitating the bath, the composite plating was carried out with the expanded metal of iron as the cathode, which was subjected in advance to the nickel plating to a thickness the plating, the temperature of the bath was maintained at 40° C., the pH value at 2.0, and the current density at 4 A/dm$^2$. As the result of this, there was obtained the composite plated layer with the co-deposited quantity of $LaNi_5$ having been 10 gr/dm$^2$. The thickness of this plated layer was approximately 350 microns, and its porosity was approximately 65%. Using this plated layer, the same short-circuiting test as in Example 1 above was conducted, after which the hydrogen overvoltage was measured. The result showed 0.10 V which was not much different from the value prior to the test.

EXAMPLE 5

The composite plating was carried out under the same condition as in Example 2 above with the exception that developed Raney nickel was substituted for the Raney nickel alloy powder. As the result, there was obtained the composite plated layer containing therein $LaNi_5$ and the developed Raney nickel, the co-deposited quantity of $LaNi_5$ having been 5 gr/dm$^2$ and the co-deposited quantity of the developed Raney nickel having been 3 gr/dm$^2$. The plated layer had its thickness of approximately 400 microns, and its porosity of approximately 70%. The plated layer was then subjected to the same short-circuiting test as in Example 1 above. The hydrogen overvoltage after completion of the test was 0.08 V which was not different from the value prior to the test.

COMPARATIVE EXAMPLE

In accordance with Example 12 of the unexamined Japanese patent publication No. 112785/1979, the composite plated cathode of Raney nickel alloy was obtained. Using this cathode, the same short-circuiting test as in Example 1 above was carried out. The hydrogen overvoltage of this cathode before the test was 0.08 V, which, however, increased to 0.25 V after completion of the test.

EXAMPLE 6

The composite plating was conducted in the same manner as in Example 1 above with the exception that $LaNi_5$ of Example 1 was replaced by Mm $Ni_{4.5}Al_{0.5}$ (where: Mm denotes Misch-metal). As the result, there was obtained a composite plated layer with the co-deposited quantity of Mm $Ni_{4.5}Al_{0.5}$ having been 9.5 gr/dm$^2$. This plated layer had its thickness of approximately 250 microns, and its porosity of approximately 60%. This plated layer was subjected to the resistance test against short-circuiting in the same manner as in Example 1 above. The result indicated that the hydrogen overvoltage was 0.15 V which was not substantially different from the value prior to the test.

EXAMPLE 7

Both nickel powder and titanium powder were mixed together to become a composition of $Ti_2Ni$. Then, the mixture was treated in an argon atmosphere by the arc melting method to produce $Ti_2Ni$. The product was comminuted to a particle size of 500 meshes or below.

6 parts of this $Ti_2Ni$ powder, 2 parts of carbonyl nickel powder, and 2 parts of PTFE powder were mixed in a mortar, followed by shaping the mixture into a sheet form. The thus obtained sheet had a thickness of approximately 1 mm, and its porosity of approximately 50%. The sheet was then press-contacted to the nickel expanded metal, after which it was calcined in an argon atmosphere at 320 C. for one hour to be made into an electrode. The thus obtained electrode was subjected to the resistance test against the short-circuiting in the same manner as in Example 1 above. As the result, the hydrogen overvoltage of the electrode was 0.17 V which was not substantially different from the value prior to the test.

EXAMPLE 8

5 parts of $LaNi_5$ (a particle size of 500-mesh below) and 5 parts of carbonyl nickel powder, both being available in the general market, were mixed together, to which aqueous solution of methyl cellulose was added as a viscosity increasing agent. The whole mixture was sufficiently mixed to prepare a paste. The paste was uniformly applied on a punched metal substrate of nickel by means of the screen-printing technique. Subsequently, the thus coated substrate was dried for one hour in air at a temperature of 100° C., after which it was calcined in the vacuum at approximately 1,000° C. for one hour, thereby forming a sintered layer of $LaNi_5$-nickel.

The $LaNi_5$-nickel sintered layer had its thickness of about 1 mm and its porosity was about 50%. From the change in weight, the quantity of $LaNi_5$ in the sintered layer was determined to be about 9 gr/dm$^2$. As the result of conducting the short-circuiting test using this sintered layer in the same manner as in Example 1 above, the hydrogen overvoltage of the electrode indicated 0.14 V which was not much different from the value prior to the test.

EXAMPLE 9

$LaNi_5$ powder having a particle size passing through a 500-mesh sieve was treated in 3% hydrochloric acid, followed by washing with water. Thereafter, the thus treated $LaNi_5$ powder was put into nickel plating chemical liquid available in the general market (a product of Kamimura Kogyo K.K., "BEL801") and adjusted to a pH value range of from 6.0 to 6.5 with ammonia water, and the plating was conducted for ten minutes at a temperature range of from 63° to 65° C. The $LaNi_5$ particles, onto which the thin nickel layer had been adhered by the plating, were filtered, washed with water, and thereafter dried. This thin nickel layer on the particles had an average thickness of 1 micron, and the weight ratio of the thin nickel layer to the $LaNi_5$ particles was 13%.

Subsequently, in accordance with the Example 1, the composite plating was carried out by use of a composite plating bath containing therein 5 gr/lit. of the above-mentioned particles and 5 gr/lit. of Raney nickel alloy powder (having a particle size passing through a 200-mesh sieve). The quantity of the $LaNi_5$ particles in the composite plated layer was 6 gr/dm$^2$, and the quantity of the Raney nickel alloy particles was 2 gr/dm$^2$. Furthermore, this composite plated layer had its thickness of about 300 microns, and its porosity of about 65%.

Subsequently, the above-mentioned cathode was developed in 20% aqueous solution of NaOH, and the resistance test against the short-circuiting was conducted thereon in the same manner as in Example 1 above. When the hydrogen overvoltage of this cathode after the test was measured in the same manner as in Example 1 above, it showed a value of 0.08 V which was not substantially different from the value prior to the test.

EXAMPLE 10

In the same manner as in Example 9 above, $LaNi_5$ particles having a particle size passing through a 500-mesh sieve was subjected to the plating for one minute, thereby obtaining the $LaNi_5$ particles coated thereon with a thin nickel layer. In this case, the thin nickel layer had an average thickness of 0.1 micron, and a weight ratio of this thin nickel layer to the $LaNi_5$ particles was 1%.

Subsequently, the cathode was manufactured by use of this particle in the same manner as in Example 9 above, with which the short-circuiting test was conducted. The result indicated that the hydrogen overvoltage was 0.085 V which was a slight increase by 5 mV from the value prior to the test.

EXAMPLE 11

In the same manner as in Example 9 above, the cathode was manufactured with the exception that no Raney nickel alloy powder was used. The cathode was then subjected to the short-circuiting test in the same manner as in Example 9 above, the hydrogen overvoltage of which indicated 0.11 V which was a slight increase by 5 mV from the value prior to the test.

We claim:

1. A highly durable cathode of low hydrogen overvoltage, which comprises an electrode core material having on the surface thereof a metal layer containing electrode active metal particles at least a portion of which particles comprises a hydrogen absorbing metal capable of electrochemically absorbing and desorbing hydrogen, wherein said metal layer has a porosity of about 20 to 90%, and further wherein a portion of said electrode active metal particles comprises Raney nickel or Raney cobalt or a mixture thereof, and said hydrogen absorbing metal is selected from the group consisting of Misch-metal/nickel system alloys, and titanium/nickel system alloys.

2. The highly durable cathode of low hydrogen overvoltage according to claim 1, wherein said metal layer comprises the same metal as the electrode active metal particles.

3. The highly durable cathode of low hydrogen overvoltage according to claim 1, wherein said metal layer on said electrode core material is selected from the group consisting of Ni, Co, Fe and Pd.

4. The highly durable cathode of low hydrogen overvoltage according to claim 1, wherein said metal layer has a thickness in the range of about 0.01 to 20 microns.

5. The highly durable cathode of low hydrogen overvoltage according to claim 1, wherein said electrode core material comprises one or more electrically conductive metals selected from the group consisting of Ti, Zr, Fe, Ni, V, Mo, Cu, Ag, Mn, Pt, group metals, graphite and Cr and an alloy thereof.

6. The highly durable cathode of low hydrogen overvoltage according to claim 1, wherein said electrode core material is selected from the group consisting of Fe, Fe-Ni*alloy, Fe-Ci alloy, Fe-Ni-Cr alloy, Ni, Ni-Cu alloy and Ni-Cr alloy.*

7. A highly durable cathode of low hydrogen overvoltage, which comprises as electrode core material having on the surface thereof an intermediate layer consisting of a metal selected from the group consisting of Ni, Co, Ag and Cu; and a metal layer on said intermediate layer containing electrode active metal particles at least a portion of which particles comprises a hydrogen absorbing metal capable of electrochemically absorbing and desorbing hydrogen, and wherein a portion of the electrode active metal particles comprises Raney nickel or Raney cobalt or a mixture thereof, and said hydrogen absorbing metal is selected from the group consisting of Misch-metal/nickel system alloys, and titanium/nickel system alloys.

8. The highly durable cathode of low hydrogen overvoltage according to claim 7, wherein said metal layer comprises the same metal as that of said electrode active metal particles.

9. The highly durable cathode of low hydrogen overvoltage according to claim 7, wherein said metal layer on said electrode core material is selected from the group consisting of Ni, Co, Fe and Pd.

10. The highly durable cathode of low hydrogen overvoltage according to claim 7, wherein said metal layer has a thickness in the range of about 0.01–20 microns.

11. The highly durable cathode of low hydrogen overvoltage according to claim 7, wherein said electrode core material comprises one or more electrically conductive metals selected from the group consisting of Ti, Zr, Fe, Ni, V, Mo, Cu, Ag, Mn, Pt group metals, graphite and Cr and an alloy thereof.

12. The highly durable cathode of low hydrogen overvoltage according to claim 11, wherein said electrode core material is selected from the group consisting of Fe, Fe-Ni alloy, Fe-Cr alloy, Fe-Ni-Cr alloy, Ni, Ni-*Cu alloy and Ni-Cr alloy.*

* * * * *